United States Patent [19]

Bennett

[11] 4,334,122

[45] Jun. 8, 1982

[54] BIMETALLIC ELECTRICAL CONNECTOR AND METHOD FOR MAKING SUCH CONNECTOR

[75] Inventor: Moreland P. Bennett, Hickory, N.C.

[73] Assignee: General Electric Company, Philadelphia, Pa.

[21] Appl. No.: 163,007

[22] Filed: Jun. 25, 1980

[51] Int. Cl.[3] ..... H01R 4/02

[52] U.S. Cl. ..... 174/94 R; 29/876; 228/127

[58] Field of Search ..... 174/94 R; 29/876, 877, 29/878; 228/126, 127

[56] References Cited

FOREIGN PATENT DOCUMENTS 1130989 9/1955 France ..... 174/94 R

*Primary Examiner*—Roy N. Envall, Jr.

*Attorney, Agent, or Firm*—William Freedman; John P. McMahon

[57] ABSTRACT

A bimetallic electrical terminator, formed from aluminum and copper members and having a hot pressure bond lock between its members is disclosed. A method for forming such a terminator is also disclosed. The bimetallic electrical terminator may be used within a separable connector to interconnect two branches of a high voltage electrical network. The bimetallic terminator has a low electrical resistance and a high mechanical strength between its aluminum and copper members.

4 Claims, 19 Drawing Figures

22

24

21
22
29
26

48
24
25
28
23

22
49
26
32

33
34
36
24
28

28
25
34
24

28
24
25
38
26
22
32
30
34

46
42
100
38
96
40
86
44

46
42
100
38
96
40
86
44

46
42
100
20
96
40
86
44

BIMETALLIC ELECTRICAL CONNECTOR AND METHOD FOR MAKING SUCH CONNECTOR

BACKGROUND OF THE INVENTION

This invention relates to a bimetallic terminator for making electrical connections and more particularly to a terminator formed from copper and aluminum members for interconnecting a solid copper conductor rod to an aluminum or copper cable within a separable connector used for high voltage networks.

The problems inherent in the forming of an electrical connection between an aluminum member and a copper member are well known to those skilled in the metal-joining art. Dissimilar metals such as copper and aluminum do not normally form good electrical bonds since such bonds normally have high electrical resistance. Further, the bonds formed between copper and aluminum members are usually weak in their mechanical properties.

It has been disclosed in U.S. Pat. No. 3,566,008, issued to L. F. Ettlinger et al, Feb. 23, 1971 and assigned to the same assignee as the present invention, that a secure mechanical joint having good electrical characteristics may be formed between copper and aluminum members. Sufficient heat and pressure is applied to a tin-plated copper member with chamfered holes therein causing extrusion of the aluminum member into the chamfered holes. While this joint may provide desirable mechanical and electrical joints between the members, it would be desirable to obtain secure mechanical and electrical connections between the copper and the aluminum members without the use of chamfered holes and without the need of a tin-plated copper member.

It has been further disclosed in U.S. Pat. No. 3,916,518, issued to B. J. Jones et al., Nov. 4, 1975, that an aluminum member may be secured to a copper member to form a one-piece bimetallic terminator by an inertia welding process. The aluminum and copper members are rotated relative to each other and are joined together by a rotational inertia welding process along the area of contact between the face of the aluminum and copper members. It is considered desirable to provide a bimetallic electrical terminator that is formed without the use of a rotational process. Furthermore, it is also desirable that the connecting joint between aluminum and copper members be internally positioned within the connector so as to reduce corrosion effects between the copper and the aluminum joint that may be caused by exposure to the atmospheric environment.

It is therefore one object of this invention to provide a copper and aluminum bond which is shielded from the atmospheric environment by a bimetallic connector housing.

Another object of this invention is to provide a method, not using rotational means, for forming the bimetallic connector.

A still further object of this invention is to provide a bimetallic terminator, formed from non-plated aluminum and copper members wherein the aluminum and copper members are bonded and mechanically locked together by a heat and pressure process.

A further object of this invention is an aluminum to copper interlocking connection that has good electrical conductivity and good mechanical strength.

SUMMARY OF THE INVENTION

Briefly in one form this invention comprises an electrical terminator. The electrical terminator has a first member of a copper material having a first end portion, a cylindrical middle portion, a cylindrical second end portion and an opening extending from the cylindrical second portion to the cylindrical middle portion. The first end portion having means for coupling to an electrical conductor. The cylindrical middle portion has a circumferential depression in its major portion and two radially outwardly projecting lips at diametrically opposite locations extending longitudinally of the middle portion. The opening has a chamber at its inner end with a circumferentially extending pocket at the entrance of the chamber. The pocket projects radially outward from the adjacent portion of the opening. The electrical terminator further comprises a second member of an aluminum material having a first end portion and a second portion. The first end portion having means for coupling to an electrical conductor. The second portion extending through the opening bonded to the walls of the opening and extruded into the chamber to a position located past the pocket at the entrance of the chamber and having a portion filling the pocket. The circumferential depression having lips and the extrusion of the aluminum second portion forming an interlocking joint of the second member within the first member. The invention also comprises a method by which the electrical terminator is formed.

The invention which is desired to be protected will be particularly pointed out and distinctly claimed in the claims appended hereto. However, it is believed that this invention and the manner in which its various objects and advantages are obtained as well as other objects and advantages thereof may be better understood by reference to the following detailed description of the preferred embodiment thereof especially when considered in the light of the accompanying drawing.

Figure 3:
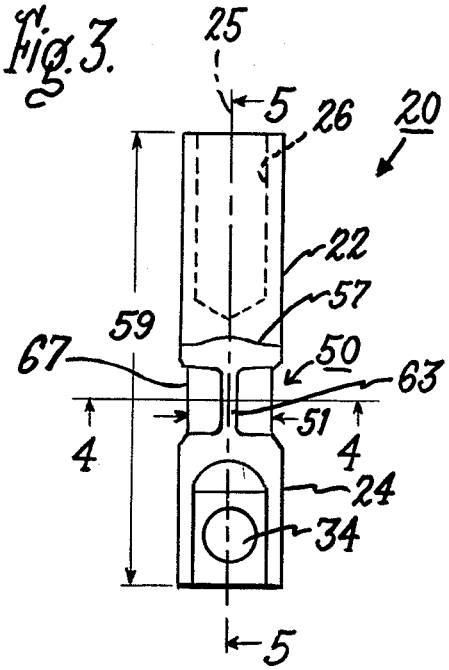
Figure 4:
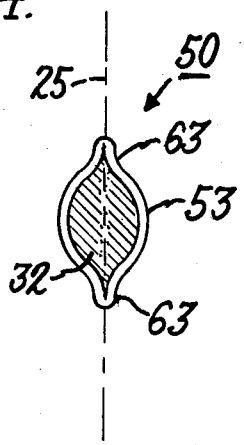
Figure 5:
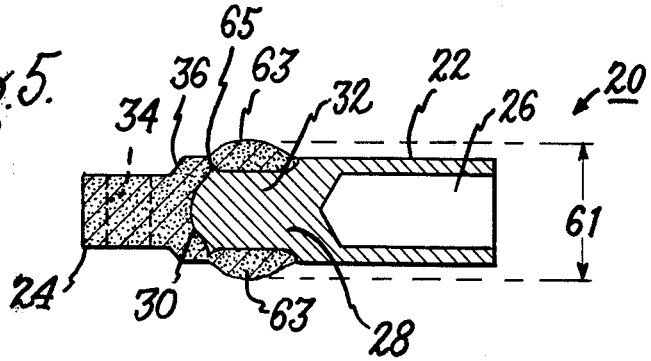
Figure 6A:
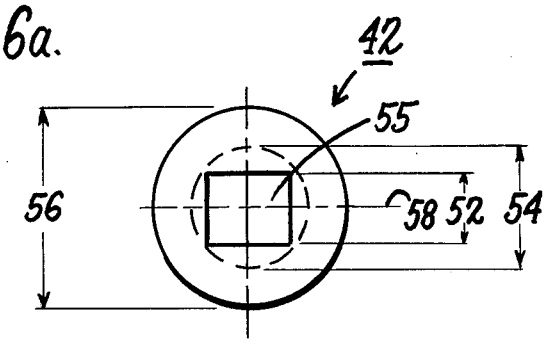
Figure 6B:
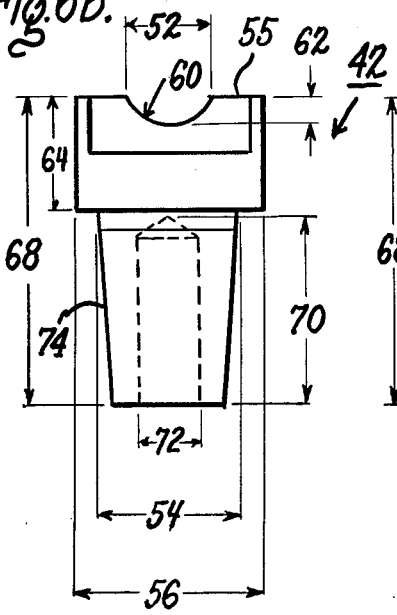
Figure 6C:
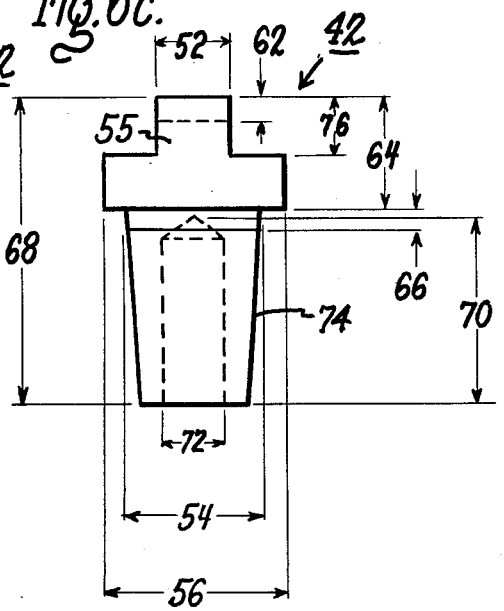
Figure 7:
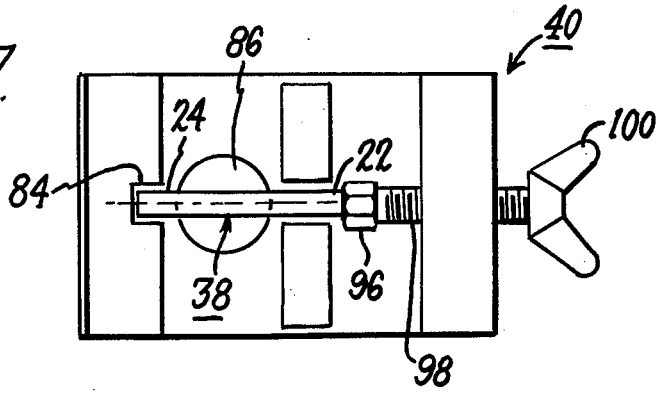

FIGS. *2a–2k* show a sequence of method steps for forming an aluminum member and a copper member into the bimetallic electrical terminator;

FIG. 3 is a top view of the bimetallic electrical terminator;

FIG. 4 is a transverse cross-sectional view of the bimetallic terminator along lines 4—4 of FIG. 3;

FIG. 5 is a longitudinal cross-sectional view of the bimetallic terminator along lines 5—5 of FIG. 3;

FIGS. *6a, 6b,* and *6c* are a top, a front, and a side view, respectively, of an electrode for a resistance heating device used in the practice of the preferred embodiment of this invention;

FIG. 7 is a top view of a holding fixture used in the practice of the preferred embodiment of this invention.

DETAILED DESCRIPTION OF PREFERRED EMBODIMENT

Figure 1:
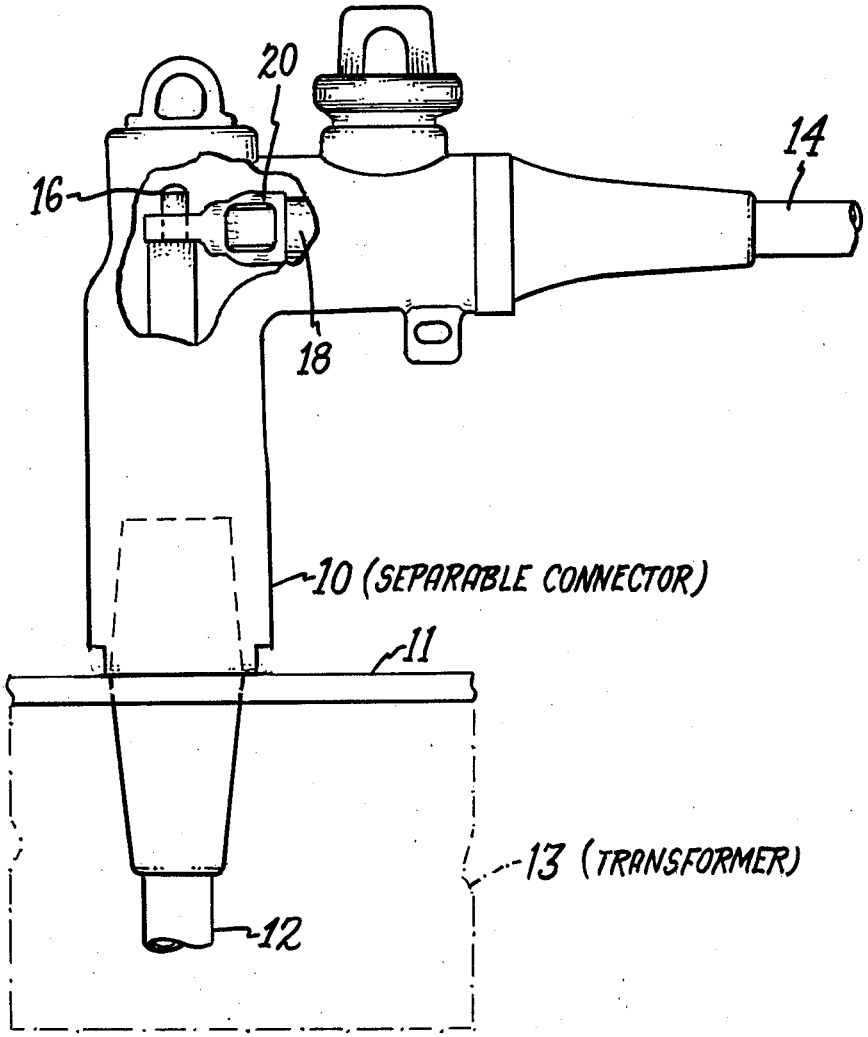
FIG. 1 shows a cut-away view of a separable connector having a bimetallic terminator for interconnecting two branches of a high voltage power network.

Referring to FIG. 1 there is shown an elbowtype separable connector 10 used for interconnecting a high voltage flexible cable 12 to a high voltage flexible cable 14. The separable connector 10 is shown as attached to a transformer casing 11 of a high voltage transformer 13. A cut-away view of the separable connector 10 is used in FIG. 1 to show a bimetallic terminator 20 interconnecting an aluminum conductor 18, associated with the high voltage cable 14, to an electrical conductor 16 associated with the high voltage cable 12. Conductors 16 and 18 are comprised of a copper material and an aluminum material respectively. Similarly, the bimetallic connector 20 is formed of a copper material and an aluminum material to provide complementary metal type mating with the copper and the aluminum cables 16 and 18 respectively.

The method of forming the bimetallic terminator 20 is shown in FIGS. *2a–2k* which broadly depict one preferred series of method or process steps in accordance with the preferred embodiment of this invention. The initial step of forming terminator 20 is to provide an aluminum member 22, shown in FIG. *2a*, and a copper member 24, shown in FIG. *2b*. The dimensions of the bimetallic terminator 20 are dependent upon the various parameters of the high voltage network, such as the current carrying capabilities of conductors 16 and 18. One exemplary bimetallic terminator 20 utilizes an aluminum member 22, having a typical diameter of 15.87 mm (0.6250 inches) and a typical length of 48.26 mm (1.9 inches), and the copper member 24 having a typical diameter of 15.87 mm (0.625 inches) and a typical length of 38.10 mm (1.5 inches).

Figures 2A, 2B, 2C, 2D, 2E, 2F, 2G, 2H:
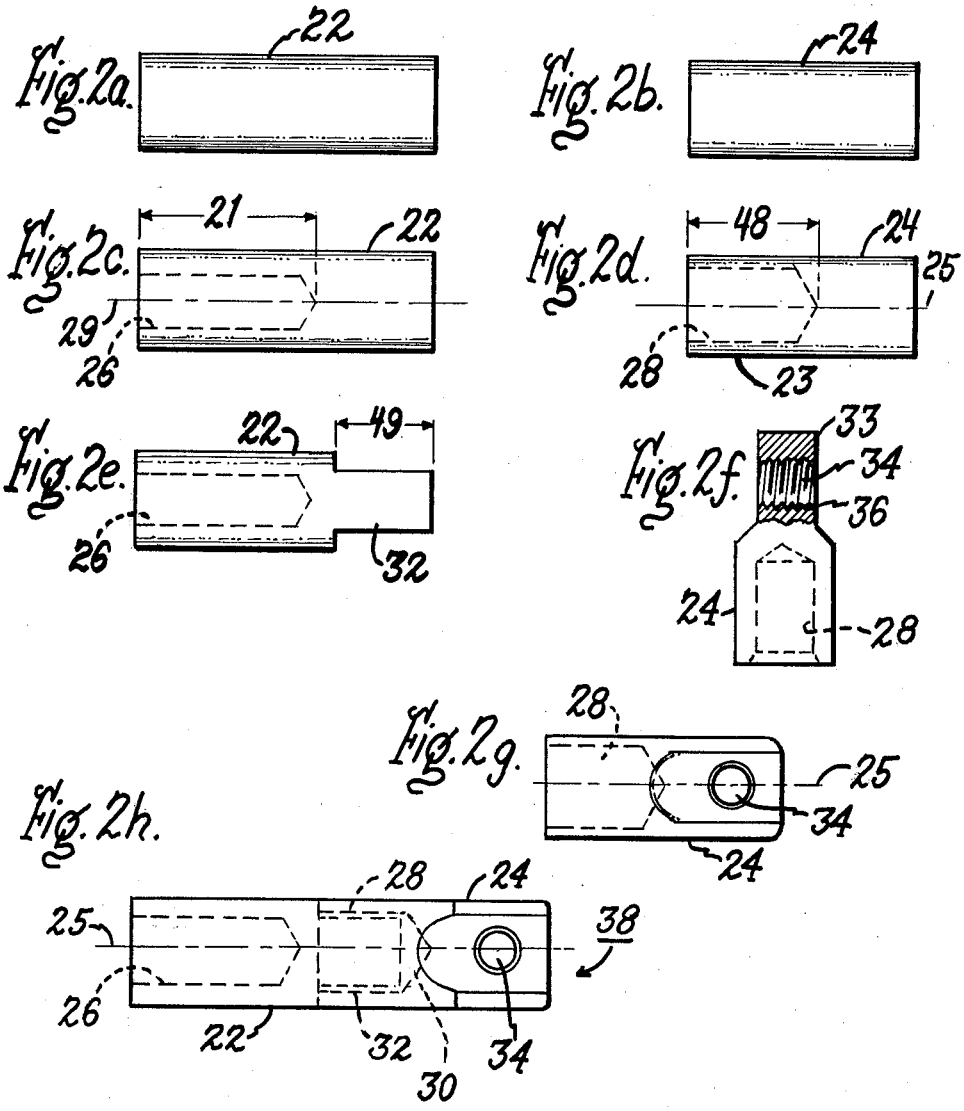
Figures 2I, 2J, 2K:
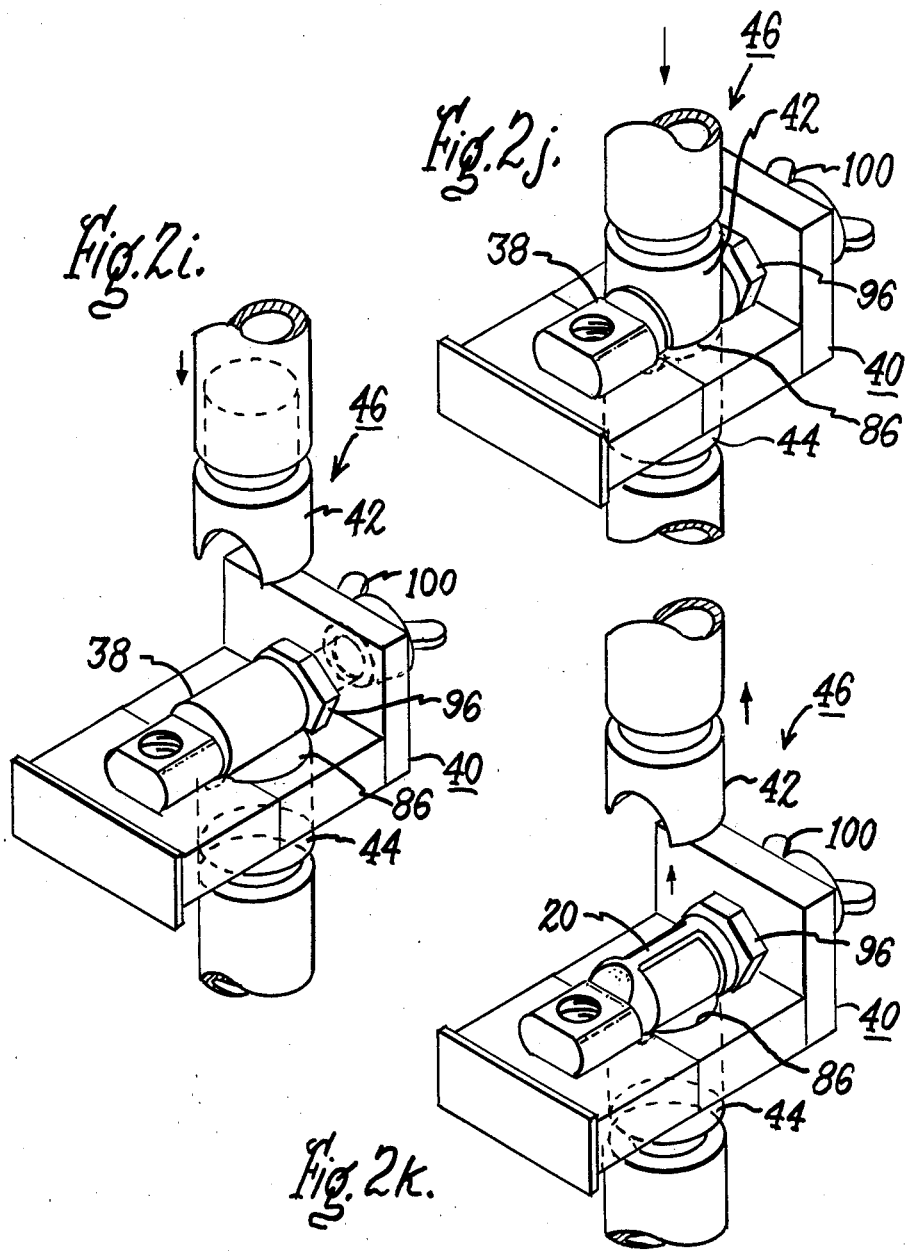

The aluminum member 22, shown in FIG. *2c*, has an opening 26 at a first end to provide a means for receiving the aluminum cable 18. The opening 26 is formed by drilling or extruding, along center line 29 of member 22, a passageway having a diameter of a typical value of 9.9 mm (0.390 inches) and a depth 21 of 28.57 mm (1.125 inches). Opening 26 allows the aluminum member 22 to be subsequently mechanically clamped onto the cable 18 by an appropriate clamping tool. A second end 32, shown in FIG. 2e, of the aluminum member 22 is reduced in diameter from 15.87 (0.625 inches) to a typical value of 12.45 mm (0.490 inches). The diameter of aluminum member 22 may be reduced during the initial metal extrusion forming process of aluminum member 22 or may be subsequently reduced by a lathing process after aluminum member 22 has been formed. The reduced diameter of aluminum member 22 extends a distance 49 having a typical value of 16.51 mm (0.650 inches). The reduced diameter of member 22 allows for insertion of the second end 32 of the aluminum member 22 into an opening 28, shown in FIG. *2d*, of the copper member 24.

The opening 28 is formed by drilling or extruding, along center line 25 of copper member 24, at a first end 23 of the copper member 24, a passageway having a typical diameter of 12.70 mm (0.5 inches) and a typical depth 48 of 19.05 mm (0.75 inches). The 19.05 mm (0.75 inches) diameter of opening 28 allows for an easy insertion of the second end 32 of member 22 into opening 28. The copper member 24 is provided with a screw type arrangement formed in an opening 34, shown in FIG. *2f*, located at the second end 33, to serve as a means for attaching to the copper conductor 16. Still further, to more easily accommodate the coupling between copper member 24 and the solid copper conductor 16, the second end 33 of copper member 24 is reduced in diameter and also provided with substantially flat surfaces by appropriate milling process. Opening 34 is formed by drilling to provide a passageway having a typical diameter of 9.40 mm (0.37 inches) and then appropriately tapped to further provide for a screw type arrangement for mating with the solid copper conductor 16 typically having a screwtype end. To further facilitate the mating with conductor 16, bevel surfaces 36 are provided by appropriate machining techniques. The formed copper member 24 having an opening 28 and the threaded opening 34 is shown most clearly in FIG. *2g*.

The intermediate stage of forming bimetallic terminator 20 is shown in FIG. *2h* as an intermediate terminator 38 formed by inserting the second end 32 of aluminum member 22 into the opening 28 of copper member 24. The intermediate terminator 38 is formed into the final bimetallic terminator 20 by a resistance welding process to be discussed hereinafter. It should be noted from FIG. *2h* that a conically shaped chamber 30 having a typical depth of 2.54 mm (0.1 inches) is formed at the inner end of opening 28. The 2.54 mm (0.1 inches) of chamber 30 is formed because the length 49 of the inserted second end 32 of member 22 is approximately 2.54 mm (0.1 inches) less than that of the depth of opening 28 of member 24.

The intermediate terminator 38 is placed in a fixture 40, partially shown in FIG. *2i*, in preparation for the resistance welding process. Fixture 40 has a thumbscrew 100 to which is attached a hextype nut 96. The adjustment of thumbscrew 100 positions the hex-nut 96 against the intermediate terminator 38 to supply a sufficient horizontal holding force for maintaining the position of the aluminum member 22 flush against the copper member 24 during a resistance welding process accomplished by a resistance welding apparatus 46. Resistance welding apparatus 46 is partially shown in FIGS. *2i*, *2j*, and *2k* as having a top electrode 42 and a bottom electrode 44. In general, resistance welding apparatus 46 supplies a vertical squeezing pressure between the electrodes 42 and 44, which is transversely applied between intermediate terminator 38, and a relatively high welding current to electrodes 42 and 44. The supplied heat and pressure, between the electrodes 42 and 44, are of a sufficient temperature and a sufficient force, respectively, to cause a hot pressure bond and a mechanical lock between the copper 24 and aluminum 22 members of the intermediate terminator 38.

The time duration of the resistance welding process, the amount of current applied to the electrodes 42 and 44, and the amount of pressure applied between electrodes 42 and 44 desired to form a bimetallic terminator 20 are dependent upon the type of aluminum material and the type of copper material comprising intermediate terminator 38. The following desired parameters for resistance welding apparatus 46 are related to the formation of a bimetallic terminator 20 from the aluminum member 22 and the copper member 24 having the previously described typical dimensions. Also, the desired resistance welding parameters are further related to the structure of electrodes 42 and 44.

The desired parameters for resistance welding apparatus 46 for forming a typical bimetallic terminator 20 are: (1) squeeze time-90 cycles, heat time-28 cycles, cool time-1 cycle, and hold time-40 cycles. The term "cycle" represents a time duration of one-sixtieth (1/60) of one (1) second. The term "squeeze time" represents a total time that the top electrode 42 takes to descend and mate with the bottom electrode 44 whereby electrodes 42 and 44 are squeezed together by a vertical force in the order of 2200 lbs. The term "heat time" represents the time during which a secondary current, in the order of 35,000 amperes, is applied to the electrodes 42 and 44. The term "cool time" represents the time during which the electrodes 42 and 44 are cooled. The term "hold time" represents the time during which electrodes 42 and 44 are mated together under pressure to allow for solidification of intermediate terminator 38. Each of the squeeze, heat, cool, and hold operations have a time duration as given above in cycles. The typical sequence of events through which the resistance welding process is performed is as follows: (1) squeeze time; (2) heat time; (3) cool time; (4) the heat time and the cool time are then repeated four times; and finally (5) hold time.

The squeeze of steps used for the resistance welding process is partially shown in FIGS. *2i, 2j* and *2k*. FIG. *2i* shows the arrangement of the intermediate terminator 38, with respect to electrodes 42 and 44, before the resistance welding process is initiated. FIG. *2j* shows the position of intermediate terminator 38, with respect to electrodes 42 and 44, during the resistance welding process. The resulting bimetallic terminator 20 produced from the intermediate terminator 38 by the resistance welding process is partially shown in FIG. *2k*.

Intermediate terminator 38 is shown in FIG. 7, as having the copper member 24 positioned into a retaining slot 84. The aluminum member 22 is shown as being positioned flush against the hex-nut 96 having a width which is greater than the diameter of the aluminum member 22. The thumbscrew 100 is adjusted to position the hex-nut 96, via a threaded bolt 98, against the aluminum member 22 so as to fix the horizontal position of intermediate terminator 38 during the resistance welding process. An opening 86 of fixture 40 provides a passageway to allow complementary mating between the top and bottom electrodes 42 and 44, respectively, during the resistance welding process. As will be discussed hereinafter, the shape of a circumferential depression 67 of a pinch weld 50 placed in copper member 24, which is formed by the resistance welding process, is dependent upon the structural shape of electrodes 42 and 44.

Electrodes 42 and 44, both formed from a heat conductive material, such as molybdenum, are substantially identical and therefore only electrode 42 shown in FIGS. *6a, 6b,* and *6c* is to be described. FIGS. *6a, 6b,* and *6c,* are a top view, a side view and a front view, respectively, of the electrode 42.

Shown in FIG. *6a* is a top view of electrode 42 having a member 55 with four sides, each side having a typical dimension of 12.7 mm (0.5 inches). The outer diameter of electrode 42 is shown as a distance 56 having a dimension of 31.75 mm (1.25 inches). The inner diameter of electrode 42 is shown as a distance 54 having a dimension of 22.22 mm (0.875 inches).

FIG. *6b* shows the member 55 as having a groove with a radius of curvature 60, having a typical value of 7.92 mm (0.312 inches), and a depth 62 having a typical value of 5.59 mm (0.22 inches). The overall height of electrode 42 is shown as a distance 68 having a typical value of 50.80 mm (2.0 inches). The bottom portion 74 of electrode 42 is shown as being tapered. The taper of electrode 42 has a dimension of a #3 Morris taper. The bottom portion 74 also has an opening 72 used as a means for conducting a cooling fluid, such as water, into electrode 42. The depth of opening 72 is shown as a distance 70 having a typical value of 31.75 mm (1.25 inches).

The upper portion of electrode 42 is shown in FIG. *6c* as having a height 64 having a typical value of 19.005 mm (0.75 inches). The height of the member 55 is shown as a distance 76 having a typical value of 9.65 mm (0.38 inches). It should be noted that the dimensions given for the member 55 determine the shape of the circumferential depression in the copper member 24 formed by the resistance welding process. The above given sequence of the resistance welding process in conjunction with the clamping fixture 40 and the electrodes 42 and 44 produce the bimetallic terminator 20 having dimensions shown most clearly in FIGS. 3, 4 and 5.

FIG. 3 shows a terminator 20 having an overall height 59 having a typical value of 69.85 mm (2.75 inches). The terminator 20 has a pinch weld 50 produced by the hereinbefore given description of the resistance welding process. The pinch weld 50 has the form of a circumferential depression 67 in the top surface of the copper portion of the terminator 20. The pinch weld 50 is located in the general area above opening 28. The pinch weld 50 has a diameter shown as a dimension 51 having a typical value of 13.716 mm (0.54 inches). The pressure and heat generated during the resistance welding process cause the copper and aluminum members of the terminator 20 to deform, which in turn produces, in part, a bulged-out boundary 57 between the copper and aluminum members of bimetallic terminator 20. The pressure and heat generated during the resistance welding process also produce various other novel features of terminator 20 shown in FIGS. 4 and 5.

FIG. 4 shows a cross-section of terminator 20 taken along lines 4—4 of FIG. 3. FIG. 4 shows outer walls 53 of the copper portion of terminator 20 clamped against the aluminum member 32 of terminator 20. This clamping is accomplished by the pinch weld 50 formed during the resistance welding process. It should be noted from FIG. 4 that the copper outer walls 53 are pinched together to form radially-outwardly projecting lips 63 at diametrically opposite locations.

FIG. 5 is a cross-sectional view along lines 5—5 of FIG. 3 showing most clearly an extrusion of the aluminum member 32 within the terminator 20. It should be noted that the aluminum member 32 is extruded into the previously discussed chamber 30 of the copper member 24. The extrusion of the aluminum member 32 into chamber 30 is caused by the heat and pressure generated during the resistance welding process.

The heat generated by the resistance welding process is transversely applied to the terminator 20. The outer surface of the aluminum member 32, making contact with the inner tubular surface of the copper member, having a lower melting point than the copper material softens or melts against the contacting copper surfaces. The pressure applied onto the copper member causes a portion of the aluminum member 32 to extrude into chamber 30. The generated pressure and heat cause the outermost portion of the chamber 30 to be bowed out and also cause chamber 30 to develop a circumferentially extending pocket 65 at its entrance. The pocket 65 projects radially outward from the adjacent portions of chamber 30. The lips 63 longitudinally extend over a major portion of the opening 28. The height of the pinch weld 50 generated during the resistance welding process is shown as a distance 61 having a typical value of 18.29 mm (0.72 inches).

The pinch weld 50 and the extrusion of aluminum member 32 within terminator 20, both created during the resistance welding process, produce a hot pressure bond lock between the copper and aluminum materials of the bimetallic terminator 20. The bond effect is developed by the aluminum material of aluminum member 32 melting and plating the heated copper material forced to contact the aluminum member 32 by the pressure and heat developed by the resistance welding process. The mechanical bond is mainly developed by the interlocking of aluminum member 32 within the chamber 30 having the circumferentially extending pocket 65 and clamping the copper outer walls 53 to the aluminum member 32 by pinch weld 50. The most critical dimension of the formed bimetallic terminator 20 is the dimension 51 of the pinch weld 50.

The hereinbefore described method of this invention was practiced to produce 14 samples of terminator 20 having a dimension 51 of pinch weld 50 within the range of 12.95 mm (0.51 inches) to 14.47 mm (0.57 inches). Eight of those samples having dimension 51 of 13.36 mm (0.526 inches), 13.10 mm (0.561 inches), 13.33 mm (0.525 inches), 13.61 mm (0.536 inches), 13.46 mm (0.530 inches), 14.32 mm (0.564 inches), 14.29 mm (0.561 inches), 14.12 mm (0.556 inches), respectively, were measured to determine their initial electrical resistance. The electrical resistance was measured between the copper portion of terminator 20, within the general area of threaded portion 34, and the aluminum portion of terminator 20, within the general area of the top surface of opening 26 of terminator 20. The initial resistance readings of all eight sample terminator 20 varied between 9 micro ohms and 10 micro ohms. The eight samples were then prepared for a shock test by clamping an aluminum conductor, such as conductor 16 into the opening 26 of the terminator 20. The eight samples were then subjected, via the conductor 16, to a current of 8000 amperes for a two second duration. The terminator 20 was then quenched in water. The terminator 20 was removed from the water and the above current was reapplied. The quenching and reapplication of current operations were repeated a total of 50 times. The electrical resistance between the aluminum and copper portion of terminator 20 was then measured and it was noted that the electrical resistance of the terminators 20 did not change from their initial values.

The remaining six other samples of terminator 20 having typical dimension 51 of 13.46 mm (0.530 inches), 14.22 mm (0.560 inches), 13.33 mm (0.525 inches), 13.59 mm (0.535 inches), 13.21 mm (0.520 inches), and 13.87 mm (0.545 inches), respectively, were subjected to a tension pull test. In preparation for the tension pull test a solid steel rod for applying a tension force was inserted into opening 26. The first sample (13.46 mm) was subjected to a tension-pull of 2850 pounds before the copper portion failed at opening 34 which was fixed in position by a solid steel rod having a screw-type end. The second sample (14.22 mm) failed after being subjected to a tension-pull of 3500 pounds at the opening 34. Similarly the third sample (13.33 mm) was subjected to a tension pull of 2900 pounds before the copper member failed at opening 34. The fourth sample (13.59 mm) was subjected to a tension-pull of 2900 pounds before the aluminum member failed in an area near the pinch weld 50. Similarly, a fifth sample (13.21 mm) failed after being subjected to a tension-pull of 2800 pounds wherein the aluminum failed in an area near the pinch weld 50. The final or sixth sample (13.87 mm) failed in the general area of pinch weld 50 after being subjected to a tension-pull of 2650 pounds.

It should now be appreciated that the hereinbefore given resistance welding process for forming terminator 20 produces a bimetallic electrical terminator 20 having an interlocking joint with a relatively low electrical resistance between its copper and its aluminum member. Furthermore, it should now be appreciated that the hereinbefore description for forming terminator 20 produces a bimetallic electrical terminator 20 having an interlocking joint with a relatively high mechanical strength between its copper and its aluminum members.

Although the forming of a bimetallic electrical terminator 20 having an outer diameter of 15.87 mm (0.625 inches) has been described in detail, it should be recognized that various other bimetallic electrical terminators having various outer diameters may be formed in accordance with the practice of this invention.

While the specified preferred embodiment has been set forth in detail, it will of course be apparent to those skilled in the art that various changes may be made to the embodiment set forth without departing from the spirit and the scope of the invention.

What is claimed is:

1. An electrical terminator comprising:

a first member of a copper material having a first end portion, a cylindrical middle portion, a cylindrical second end portion and an opening extending from said cylindrical second portion to said cylindrical middle portion, said first end portion having means for coupling to an electrical conductor, said cylindrical middle portion having a circumferential depression in its major portion and two radially-outwardly projecting lips at diametrically opposite locations extending longitudinally of said middle portion, said opening having a chamber at its inner end with a circumferentially extending pocket located at the entrance to said chamber, the pocket projecting radially outwardly from the adjacent portion of said opening, and;

a second member of an aluminum material having a first end portion and a second portion, said first end portion having means for coupling to an electrical conductor, said second portion extending through said opening bonded to the walls of said opening, and extruded into said chamber to a position located past said pocket at the entrance of said chamber and having a portion filling said pocket;

said circumferential depression having lips and said extrusion of the aluminum second portion forming an interlocking joint of said second member within said first member.

2. An electrical terminator according to claim 1 wherein said circumferential depression has a diameter being within the range of 12.95 mm to 14.47 mm and the spacing between the upper-most portions of the two radially projecting lips is about 18.29 mm.

3. A method for producing a bimetallic terminator formed from a copper member and an aluminum member, said method comprising the steps of:

a. forming a first end of said copper member to obtain an opening having a predetermined depth;

b. forming a first end of said aluminum member to allow for insertion into said opening of said copper member;

c. inserting said first end of said aluminum member into said opening of said copper member to a depth less than said predetermined depth so as to form an empty chamber at the inner end of said opening;

d. clamping said aluminum member against said copper member to block relative longitudinal movement of said members;

e. applying a transverse force to squeeze said first end of said copper member into contact with said first end of said aluminum member;

f. applying heat to cause the surfaces of said first end of said aluminum member contacting said first end of said copper member to melt;

g. containing said applied transverse force and said applied heat to cause said first end of said aluminum member to extrude into said chamber of said copper member and further cause said first end of said copper member to develop a circumferential depression and collapse onto and form a pinch weld with said first end of said aluminum member, whereby said melting of said first end of said aluminum member forms a plating bond between said ends and said pinch weld forms a mechanical bond between said aluminum and copper members.

4. The method of claim 3 in which said collapsing action causes: (a) a deformation of said opening that produces at the entrance to said chamber a pocket that projects radially outward from the adjacent portion of said opening, and (b) forces said aluminum extruded into said chamber to flow into and fill said pocket.

* * * * *